United States Patent [19]

Briner et al.

[11] 4,389,840

[45] Jun. 28, 1983

[54] METHOD OF AUTOMATICALLY DOFFING THE FULL BOBBIN PACKAGES FROM, AND DONNING THE EMPTY BOBBIN TUBES ONTO, THE SPINDLES OF A PREPARATORY SPINNING MACHINE

[75] Inventors: Emil Briner; Peter Novak; Bruno Tanner, all of Winterthur; Hermann Gasser, Frauenfeld, all of Switzerland

[73] Assignee: Rieter Machine Works Limited, Winterthur, Switzerland

[21] Appl. No.: 243,947

[22] PCT Filed: Jun. 30, 1980

[86] PCT No.: PCT/EP80/00040

§ 371 Date: Mar. 10, 1981

§ 102(e) Date: Mar. 2, 1981

[87] PCT Pub. No.: WO81/00264

PCT Pub. Date: Feb. 5, 1981

[30] Foreign Application Priority Data

Jul. 10, 1979 [CH] Switzerland ..... 6420/79

[51] Int. Cl.[3] ..... D01H 9/04

[52] U.S. Cl. ..... 57/267

[58] Field of Search ..... 57/67, 70, 71, 267, 57/266, 276

[56] References Cited

U.S. PATENT DOCUMENTS

| | | | |
|---|---|---|---|
| 246,469 | 8/1881 | Daly | 57/67 |
| 1,049,545 | 1/1913 | Stell et al. | 57/267 |
| 1,263,714 | 4/1918 | Stell et al. | 57/267 |
| 1,263,715 | 4/1918 | Stell et al. | 57/267 |
| 3,935,699 | 2/1976 | Iida et al. | 57/267 |

FOREIGN PATENT DOCUMENTS

| | | |
|---|---|---|
| 2521057 | 1/1976 | Fed. Rep. of Germany . |
| 2543842 | 4/1976 | Fed. Rep. of Germany . |
| 442090 | 1/1968 | Switzerland . |
| 1302863 | 1/1973 | United Kingdom . |

*Primary Examiner*—John Petrakes

*Attorney, Agent, or Firm*—Werner W. Kleeman

[57] ABSTRACT

The present invention concerns a method of automatically doffing the full bobbin packages from, and donning the empty bobbin tubes onto, the spindles of a preparatory spinning machine equipped with flyers. The flyers are of the so-called suspended type, i.e. they are rotatably supported in a flyer head.

For the conjoint, vertical doffing of the full bobbin packages, and for the conjoint, vertical donning of the empty bobbin tubes the flyers are pivoted to the side in such manner, that they cannot obstruct the doffing of the full bobbins any more.

The inventive preparatory spinning machine comprises a common support beam in which the flyers are rotatably supported, in which arrangement the beam can effect a translatory movement in such manner that each flyer can be brought into an inclined position.

17 Claims, 16 Drawing Figures

Fig. 1
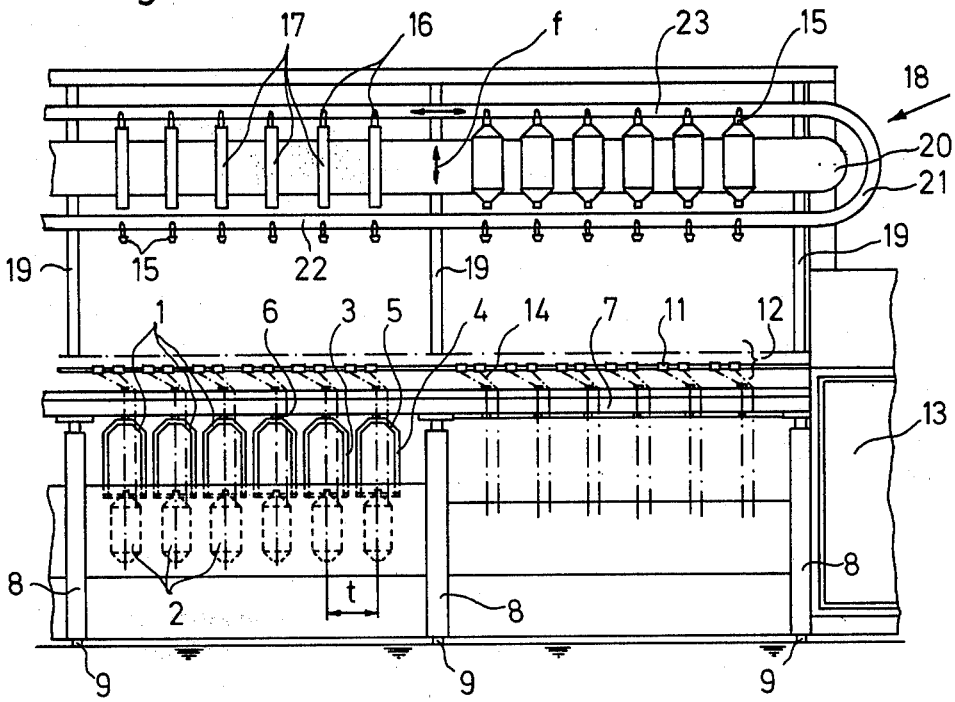
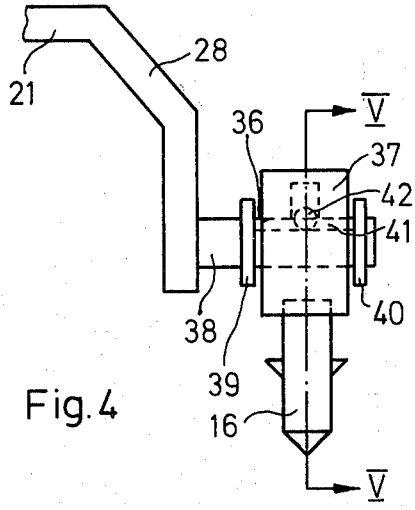
Fig. 4
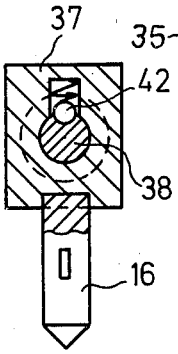
Fig. 5
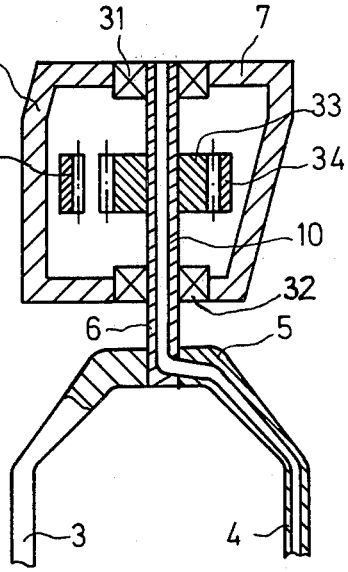
Fig. 6

METHOD OF AUTOMATICALLY DOFFING THE FULL BOBBIN PACKAGES FROM, AND DONNING THE EMPTY BOBBIN TUBES ONTO, THE SPINDLES OF A PREPARATORY SPINNING MACHINE

BACKGROUND OF THE INVENTION

Method of automatically doffing the full bobbin packages from, and donning the empty bobbin tubes onto, the spindles of a preparatory spinning machine equipped with at least one row of spindles and with flyers, each rotatably supported in a flyer head above a spindle, and consisting of two flyer arms and a flyer yoke, as well as an apparatus for implementing the method.

Preparatory spinning machines of this type, also called flyer, are used in the spinning process for staple fibre spinning in the penultimate stage of the manufacturing process. They are used for producing a draftable roving, which is wound onto a big-sized bobbin package and is creeled to the subsequent processing machine, normally the spinning machine. Due to the trend of producing bobbin packages of ever-increasing size, and thus weight, the operation of manually exchanging full bobbin packages against empty bobbin tubes has become ever more difficult for the operating personnel, and thus many attempts have been undertaken already of adapting the shape and construction of the working elements, and particularly that of the spindles and flyers, for establishing the conditions allowing for a mechanisation of the operation.

Thus, a preparatory spinning machine of the type mentioned initially is known from Swiss Pat. No. 442,090, in which each flyer is supported in an upper support, mounted fixedly with respect to the room, and is driven, and supports a donning pinfor the bobbin tube, and in which a vertically movably guided bobbin support member supports the spindle in the form of a short donning pin. As the bobbin support member is lowered for the doffing operation the donning pin of the flyer is lifted off the bobbin tube, in such manner that the bobbin package merely rests on the short donning pin of the spindle. As the bobbin support is lowered further, the distance between the lower end of the donning pin of the flyer and the upper end of the bobbin tube exceeds the depth of penetration of the donning pin of the spindle into the bobbin tube. Owing to this arrangement the full bobbin package now can, after being lifted above the donning pin of the spindle, be moved off at a bias to the spindle and to the longitudinal axis of the machine. An empty bobbin tube also can be brought in at a bias to the spindles and to the longitudinal axis of the machine in the free room or space between the spindle and the flyer, and can be donned onto the donning pin of the spindle by slight lowering. As the bobbin package support member is lifted into the working position the bobbin tube now is brought into the correct position relative to the flyer, with which process the exchange operation is to be considered finished. This device, in which elements for corresponding movements at a bias of the bobbin packages and of the bobbin tubes are provided, realizes the mechanized exchange of the bobbin on a preparatory spinning machine.

This arrangement, however, shows several considerable disadvantages. Thus, the bobbin support member is required to be lowerable over more than the whole bobbin tube length, or outside the normal lift range of the bobbin support member. This implies an unfavourably high position of the working elements during normal machine operation, which involves operational disadvantages.

Furthermore, doffing "at a bias" of the bobbin packages implies blockage of the room or space in front of the machine, namely before the exchange operation by the bobbin tubes held in readiness, and after the operation by the full bobbin packages doffed. The working elements required, formed as fork-shaped grippers which are pivotable about a vertical axis, hamper the operation of the machine at all times.

According to a similar proposal shown in German Pat. No. 2,543,842 there are also provided lowerable spindles and flyers located at fixed level with respect to the room and equipped with a donning pin. In this arrangement, however, the bobbin packages and the bobbin tubes no longer, as in the above mentioned example, are moved at a bias to the spindle and to the longitudinal machine axis, away from the spindle, or to the spindle, respectively, but are moved at a bias to the spindle but parallel to the longitudinal machine axis. For this purpose a transporting belt is provided above the bobbin support member onto which the bobbin tube foot ends of the doffed bobbin packages are placed after the donning pins of the spindles have been lowered still further. The full bobbins thus are moved away from the machine in a vertical position, at a bias to the spindle axis, and in longitudinal direction of the preparatory spinning machine, and thereafter the empty tubes are positioned in the same manner.

This arrangement also shows the above mentioned, operational disadvantages, due to the length of the lowering movement of the bobbin support member which is required. It does not, however, occupy additional room in front of the machine. Due to the presence of the transporting belt, which is to be provided with individual bobbin and tube support members, the arrangement, however, is expensive and, furthermore, requires considerable efforts for maintenance and cleaning.

Furthermore, from U.S. Pat. No. 246,469 there are known preparatory spinning machines equipped with flyers supported in bearings at the upper and at the lower part, i.e. with "closed" flyers, aiming at facilitated doffing operations, with the spindles detachable at the lower part, and by pivoting them about the upper bearing serving as a guide into a position of the bobbin suitable for doffing the bobbin package downward and inclined towards the front.

This arrangement presents the disadvantage that the spindle is to be designed to be detachable, resulting in complicated coupling designs, especially if this principle should be applied at today's usual very high rotational speeds, and that doffing can be effected only from below, which operationally is unfavourable.

Furthermore, according to German Pat. No. 1,012,542, it has also been proposed to use a flyer on preparatory spinning machines, which at its lower end is provided with a running ring, and which is provided with a free flyer head. This flyer furthermore can be pivoted about an axis arranged at right angles to its rotational axis to the running ring, the diameter of which corresponds to the width of the flyer and is mounted thereon. Elastic shape-hugging elements are provided between the flyer and the running ring, which elements snap onto the flyer. For doffing the full bobbin package from the spindle the flyer now is tilted or pivoted laterally, respectively, which is effected by overcoming the fixing forces between the flyer and the running ring, generated by the elastic shape hugging elements.

In addition to great doubt as to the out of round running of this known design of such flyers the top portion of which rotates freely, there prevails a very pronounced danger of damage and injury if accidentally flyers leave their vertical position e.g. under the influence of unbalances, which flyers then can collide mutually. Tilting of the flyer by hand, while the flyer is at a standstill, for doffing the full bobbin packages, also could result in difficulties, as the distance between the flyer head and the drafting arrangement cannot be increased without bringing about the danger of tearing the roving located therebetween.

Furthermore, according to German Patent Publication No. 2,521,057, it has become known, that for facilitating the doffing operation of the bobbin package, the bobbin rail, including the bobbins is pivoted on the bobbin rail support in such manner that the bobbin can be tilted into an inclined position for doffing. Thus, presentation of the bobbin packages for doffing is achieved in a position inclined to the front and upward, to the operating personnel, without, however, making impossible unhampered doffing of the bobbin packages, especially from the innermost row on double row machines. If this principle is to be applied to a preparatory spinning machine with an automatic doffing device, also the operational disadvantages (obstruction of the room in front of the machine) mentioned in connection with the above mentioned Swiss Pat. No. 442,090 would occur. Furthermore, a tiltable design of the heavy bobbin rail, which reciprocates up and down, is problematic as far as the forces involved are concerned.

SUMMARY OF THE INVENTION

It thus is an important object of the present invention to eliminate the above mentioned disadvantages of the known devices for automatically doffing the full bobbin and donning the empty bobbin tubes on a preparatory spinning machine of the type mentioned initially and to propose a method and an apparatus for this purpose, which in particular:

(a) ensures fully automatic operation of the doffing and donning apparatus, in which:
(b) the normal operation of the preparatory spinning machine is not impaired in any manner,
(c) the working elements of the preparatory spinning machine are located at the optimum height,
(d) the doffing and donning operations are effected during a minimum standstill period of the preparatory spinning machine, and
(e) so-called "closed" flyers can be used.

The apparatus for implementing the method according to the invention furthermore is robust and reliable in operation and requires a bare minimum of maintenance.

This object is achieved in a method of automatically doffing the full bobbin packages from, and donning the empty bobbin tubes onto, the spindles of a preparatory spinning machine equipped with at least one row of spindles and with a flyer rotatably supported in a flyer head above each spindle, consisting of two flyer arms and a flyer yoke, by applying the following steps of the method:

(a) bringing the machine to a standstill with the flyers in a same determined position,
(b) pivoting of all flyer heads in a plane arranged at right angles with respect to the plane containing both flyer arms of each flyer, each flyer being inclined to such a position, in which the flyer yoke does not obstruct the vertical doffing of the full bobbin package from the spindle,
(c) conjoint, vertical doffing of the full bobbin packages from all spindles, arranged in a row, the roving being severed between the flyer and the bobbin package, and a free fibre beard being formed at the flyer,
(d) conjoint transfer of the full bobbin packages from the doffing position vertically above the spindles, and transfer of the empty bobbin tubes to the same position,
(e) conjoint, vertical donning of the empty bobbin tubes onto all spindles arranged in a row, the severed fibre beard being clamped between the bobbin tube foot portion and the spindle,
(f) pivoting back all flyer heads to the working position vertically above the spindles, and
(g) starting up the preparatory spinning machine.

The preparatory spinning machine for implementing the inventive method is provided with the following characteristics:

(a) The flyer heads of the flyers coordinated to the spindles arranged in a row are supported in a common support beam extending in the longitudinal direction of the machine, which beam for the doffing of the full bobbins and for the donning of the bobbin tubes effects a translatory movement in such manner that each flyer is pivoted substantially about an axis, which symmetrically intersects both flyer arms in its lower part,
(b) above the spindles there is provided a doffing and donning element movable up and down, and comprising a gripper for the full bobbin package and a bobbin tube support member for the empty bobbin tube, and
(c) control devices are provided, by means of which the flyers for the doffing operation can be brought to a standstill in their position predetermined for their pivoting.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a view from the side of an inventive preparatory spinning machine during a phase of the doffing and donning operation, FIGS. 3*a* through 3*l* illustrate the various steps of the inventive doffing and donning operation on a preparatory spinning machine, FIG. 4 is a detail of a bobbin tube supporting member for the empty tubes according to a preferred embodiment of the invention.

FIG. 5 is a detail of FIG. 4, shown in a section along line V—V of FIG. 4, and FIG. 6 illustrates a particularly advantageous embodiment of the trough supporting the flyers.

DETAILED DESCRIPTION OF THE PREFERRED EMBODIMENTS

Figure 2:
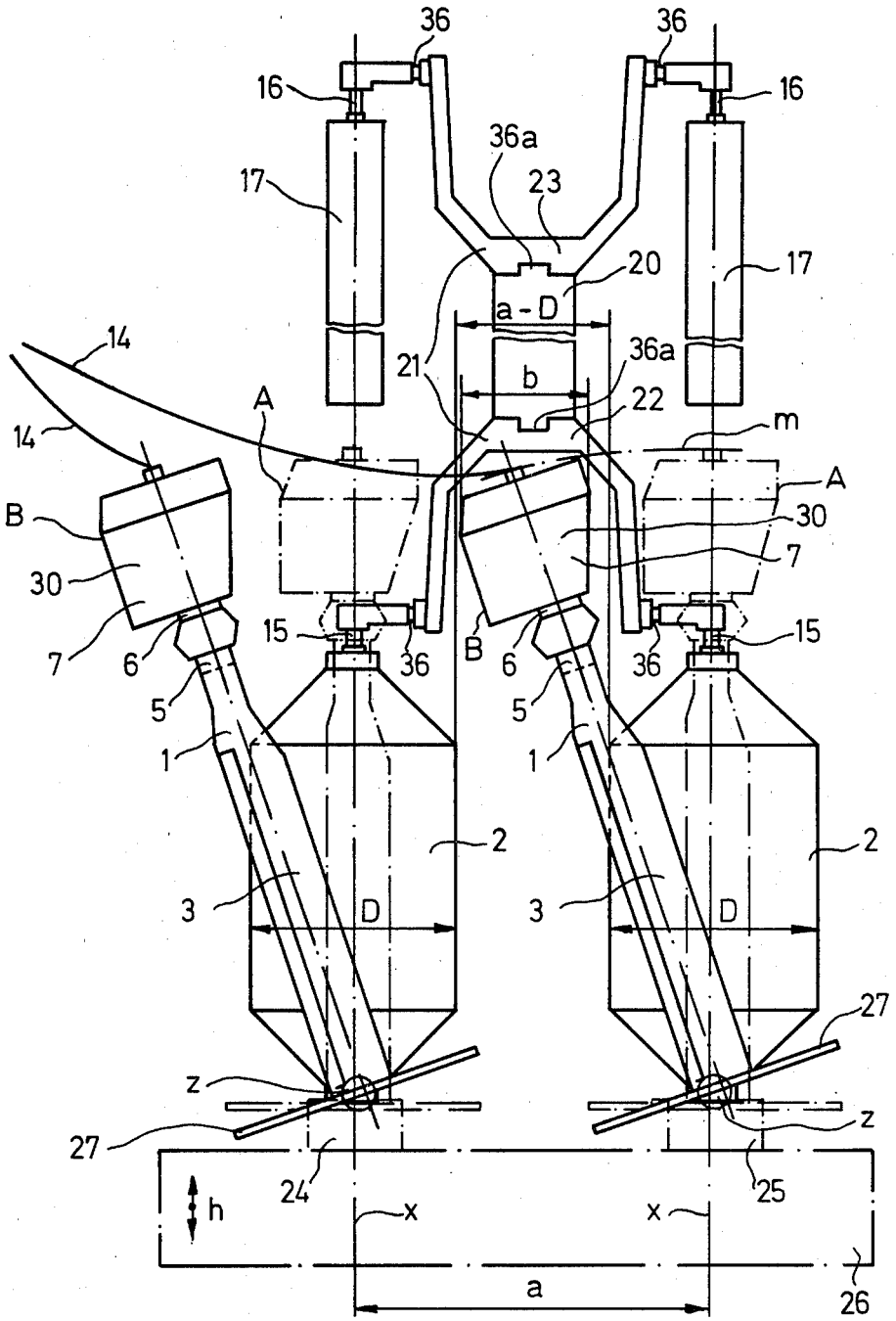
FIG. 2 is a cross-section of a double row preparatory spinning machine during the doffing operation of the full bobbin packages, only the elements directly involved in the change operation merely being shown for better simplicity.

In FIG. 1 a schematic view is given of an inventive preparatory spinning machine, only the elements required for understanding the teachings of the invention being shown for better simplicity.

A machine of such type consists of spindles arranged in at least one row, onto which the bobbin tubes, upon which the roving is wound as a bobbin package 2, are donned, and coordinated flyers 1 arranged co-axially during operation. The spindles are indicated in FIG. 1 merely by the bobbin packages 2 placed onto them: the spindles are mounted in a manner known as such on a spindle rail, which is not shown, which can be moved up and down in vertical guides (not shown) distributed along the machine and which is equipped with the drive elements required for rotating the spindles.

The flyers 1, which consist of two arms 3 and 4 and of a yoke 5 (compare also FIG. 6, where an enlarged view of the upper portion of a flyer is shown), are rotatably supported with their flyer heads 6 (compare also FIG. 6) in a support beam 7 extending along the whole machine. The support beam 7 is supported by columns 8 distributed along the machine, which in their lower portion are linked to a frame which is fixed relative to the room, and which is not described in greater detail. For simultaneous parallel pivoting of the columns at a bias or transversely to the longitudinal axis of the machine, corresponding means (not shown) are provided.

The flyer head 6 consists, as shown in FIG. 6, of a partially hollow axis or shaft 10. On the frame of the machine, which is fixed relative to the room, there is furthermore fixed a drafting arrangement 12, known as such, consisting of a series of rolls (one of them only being indicated and designated with the reference number 11) and corresponding pressure rolls. Furthermore, the machine is provided with a creel arranged above or behind the drafting arrangement (not shown) from which textile fibre slivers are supplied to each spinning position.

The spindles, the flyers 1 and the drafting arrangement 12 are driven in a manner known as such from e.g. a drive head stock 13 arranged at one end of the preparatory spinning machine, in which also the further drive elements for the elements to be described of the doffing and donning mechanism (e.g. for the simultaneous, parallel pivoting of the columns 8) can be housed.

In normal operation of the preparatory spinning machine each spindle and the flyer 1 coordinated to it rotate co-axially, i.e. the flyer 1 is arranged in vertical position above the spindle. The roving 14 supplied from the drafting arrangement 12 is guided through the hollow axis or shaft 10 of the flyer head 6, passes through one of the flyer arms 3,4 (e.g. flyer arm 4 according to FIG. 6) and is wound by a presser finger (not shown) onto the surface of the corresponding bobbin 2. The relation to be maintained for this purpose between the rotational speeds of the spindle and of the flyer are known to any specialist skilled in the art and are not described here in more detail. By moving up and down the spindle which supports the bobbin package 2 an orderly deposition of the roving in parallel windings on the surface of the bobbin 2 is effected.

The inventive preparatory spinning machine furthermore is equipped with a doffing and donning element or device 18 which can move up and down above the spindle, and which contains a gripper 15 for each full bobbin package 2 and a bobbin tube support member 16 for the empty bobbin tubes 17, which element is e.g. in the form of a beam 20 guided on vertical guides 19.

The double arrow f in FIG. 1 indicates the movement of the doffing beam 20, which is effected by using means not shown (e.g. block and pulley arrangements, or pneumatic cylinders).

In a preferred embodiment of the invention the beam 20 is provided with a chain 21 (shown schematically in FIG. 1, i.e. without the segments of which it is formed) revolving in a vertical plane, along which chain 21 the grippers 15 and the bobbin tube support members 16 are mounted.

In this arrangement, according to a preferred embodiment of the chain 21 one longitudinal leg or run of the chain, e.g. the lower leg 22, can be provided with the grippers 15 for the full bobbin packages 2 arranged at equal mutual distances or spacing corresponding to the spindle gauge t, whereas the second longitudinal leg or run, i.e. e.g. the upper leg 23 is provided with the bobbin tube support members 16 for the empty bobbin tubes 17, also arranged at the same mutual distances corresponding to the spindle gauge t.

In this context it should be noted that the descriptions "lower" leg and "upper" leg are only correct with respect to the illustration in FIG. 1, as in the more detailed description later on of the function of the chain it will be described how the chain, revolving over half its length moves the grippers 15, first located in the lower leg 22 up to the upper leg 23, whereas the bobbin tube support members 16, first located in the upper leg 23 are moved inversely.

The arrangement of the chain 21 shown here with its legs or runs 22 and 23 revolving in a vertical plane shows the advantage of an optimum room or space utilization in comparison to another chain arrangement (not shown) which could be considered, with a chain revolving in a horizontal plane, particularly if a double row machine is concerned, as is the case in most applications of such preparatory spinning machines.

A double row machine of such type is shown schematically in a cross-section in FIG. 2, in which, however, merely the elements concerned within the scope of the present invention are shown. The elements identical to the ones shown in FIG. 1 are designated with the same reference numbers. In FIG. 2 the two rows of spindles 24 and 25 are shown, which are rotatably supported and driven in a spindle or bobbin rail 26 shown schematically. The spindle rail 26 effects the above mentioned up and down reciprocating movement for depositing the roving on the bobbin package 2, which movement is indicated with the double-headed arrow h. In FIG. 2, the preparatory spinning machine is shown during a phase of the doffing operation of the full bobbin packages 2 and permits particularly apt description of the room or spatial conditions to be maintained for the inventive sequence of operations.

It should be noted, that the flyers 1 shown in FIG. 2 are "closed" flyers, i.e. flyers of the type in which the flyer arms 3 and 4 at their free lower ends are interconnected with e.g. a ring 27, the inside diameter of which exceeds the diameter D of the full bobbin package 2. Such "closed" flyers present the advantage that they are suitable for the highest rotational speeds, as the ring 27 reinforces them very effectively. On the other hand, the presence of such a ring 27 on the flyer 1 on the inventive preparatory spinning machine, on which the doffing of the full bobbin package 2 and the donning of the empty bobbin tube 17 are effected in vertical direction, is of no consequence in the sense of an obstruction of the above mentioned operation.

Of course also "open" flyers, i.e. flyers, the arms 3,4 of which at their free ends are not interconnected, can be applied without difficulties within the scope of the present invention.

In FIG. 2 now the movement of the support beam 7 (two of which are present in this arrangement) is indicated, which starting from its working position A, shown with dash-dotted lines, is brought by pivoting into its doffing position B (shown with solid lines) in which all flyers 1 supported therein of a row are inclined with respect to the corresponding spindle axis x. In this arrangement, the pivoting movement of the support beam 7, which in its general form is to be considered as a translatory movement, is effected in the example illustrated in FIG. 2 in such manner, that each flyer 1, which for the doffing operation had been brought to a standstill in such a position, that both arms 3 and 4 are arranged in the plane containing all spindle axes x of a row of spindles, are pivoted substantially about an axis z intersecting both flyer arms 3 and 4 in their lower position.

In FIG. 2 the projection of the axis z is marked as a small circle purposely for stressing that the pivoting axis z is not required to be fixed with respect to the room during the pivoting movement (which would imply that the flyer head 6 of each flyer and the support beam 7 move along a circular arc, the centre of which is located in z) but that it can be displaced slightly.

It is important, only, that the pivoting axis z intersects the flyer arms 3 and 4 symmetrically, which is achieved in that before pivoting of the flyers 1, these flyers 1 are brought to a standstill in a position in which each flyer yoke 5 (compare FIG. 1) is located in a plane arranged at right angles with respect to the pivoting motion.

If, as imaginable, but not shown, the flyer 1 in its lower position, e.g. with its ring 27, is additionally linked to a sleeve rotating concentrically with the spindle, the pivoting motion of the flyer 1 of course must be effected about this link axis (not shown), in which case the flyer head 6 moves along a circular arc in its pivoting motion. In FIG. 2 the path of the highest point of the support beam 7 described during the pivoting motion from the position A to the position B is indicated with dash-dotted lines m.

The function of the inventive preparatory spinning machine now is described with reference to FIG. 3*a* through 3*l* showing the individual steps schematically. Also here, for simplicity, only the elements required for understanding the function being shown. In FIGS. 3*a*, 3*b*, 3*c*, 3*d*, 3*f*, 3*g*, 3*h*, and 3*i* simplified cross-sections of a double row preparatory spinning machine are shown, whereas in FIGS. 3*e*, 3*k* and 3*l* the end portion of the preparatory spinning machine is shown, where the chain 21 is relieved or freed from the transported full bobbin packages 2, and is supplied with empty bobbin tubes 17, respectively.

Figure 3A:
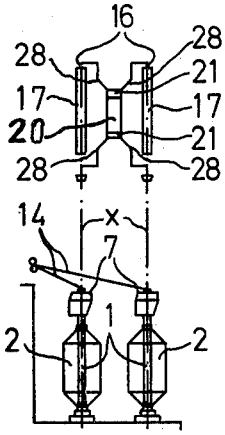

In FIG. 3*a* the situation is shown shortly after completion of the bobbin packages 2 and stopping the machine. The flyers 1 are brought to a standstill in a determined or predetermined position, namely, as shown in this example, such, that the plane containing the two flyer arms is parallel to the support beam 7. Symmetrically above the spindle a support beam 20 is provided which is equipped with one single revolving chain 21. The grippers 15 and the bobbin tube support members 16 on each side of the beam 20 are connected with the revolving chain 21 at both sides by bevelled arms 28, as described later on with reference to the enlarged illustration of FIG. 2 in more detail. The bobbin tube support members 16 located in the upper leg or run of the chain are loaded with empty tubes 17.

Figure 3B:
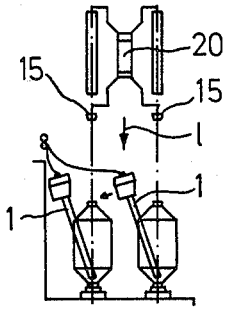

In FIG. 3*b* the flyers 1 are pivoted to the side and the beam 20 is being lowered onto the spindles, as indicated by the arrow 1.

Figure 3C:
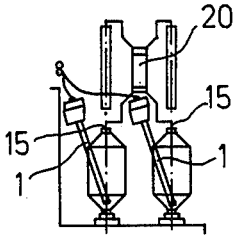
Figure 3D:
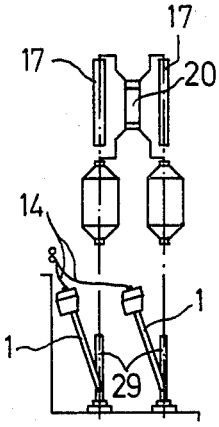

In FIG. 3*c* the grippers 15 have gripped the full bobbin packages 2 and the beam 20 returns to its uppermost position according to FIG. 3*d*, the bobbin package 2 being doffed from the spindles 29. During this operation the roving 14 at all spinning position was severed, in a manner known as such, between the flyer 1 and the bobbin package 2.

Figure 3E:
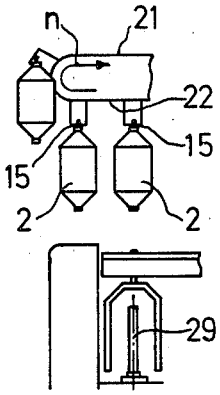

In FIG. 3*e* shown the manner in which upon revolving of the chain 21 over half its length (the movement being indicated by arrow n) the grippers 15 first located in the lower chain leg or run 22 are moved with the bobbin packages 2 to the upper chain leg 23, whereas the bobbin tube support members 16 supporting the empty tubes 17 move inversely. In a preferred arrangement according to the invention this movement of the bobbin packages 2 and of the empty bobbin tubes 17 is effected in such manner that the grippers 15 and the bobbin support members 16 always hang down from the chain 21 under the influence of gravity, as to be described in more detail later on.

Figure 3F:
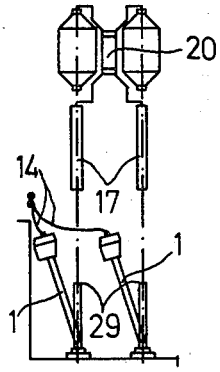
Figure 3G:
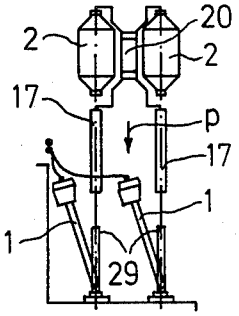
Figure 3H:
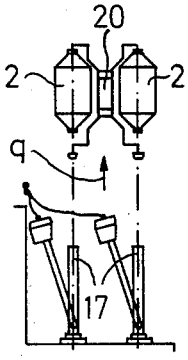
Figure 3I:
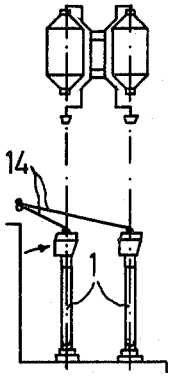
Figure 3K:
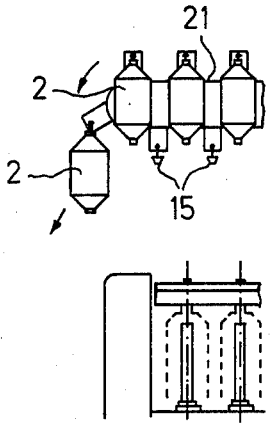
Figure 3L:
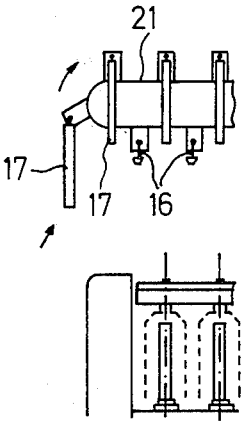

In FIG. 3*f*, the empty bobbin tubes 17 are readied vertically above the spindles 29 for the donning operation, which is shown taking place in FIG. 3*g*. Arrow p indicates the down movement of the beam 20 with the empty tubes 17. In FIG. 3*h* it is shown how the beam 20 already after donning the empty tubes 17 (the torn fibre beard being clamped between the bobbin tube foot portion and the spindle in the process, as known as such) onto the spindle 29 is moved back to its uppermost position (indicated by arrow q) and (as shown in FIG. 3*i*) is stopped in this position again. Furthermore; FIG. 3*i* shows that the flyers 1 have been pivoted back into their working position, the rovings 14 again are extended between the drafting arrangement (not shown) and the flyer head, and the preparatory spinning machine can be started up again. In FIGS. 3*k* and 3*l* it is shown, how during the normal operation of the machine the bobbin packages 2 are eliminated from the grippers 15 at one end of the machine while the chain 21 revolves, and how on the bobbin tube support members 16 empty tubes 17 are readied for the next doffing and donning operation.

It is to be noted, that on the preparatory spinning machine control means, not described in more detail and known as such, are provided, e.g. in the drive headstock 13, which influence the drive means for rotating the flyers 1 and effect stopping of the flyers 1 in their position determined for their pivoting.

With reference to FIGS. 2 through 6, already described, now further preferred embodiments of the invention are described in more detail.

Thus, the common support beam 7 extending in longitudinal direction of the machine, in which the flyer heads 6 of the flyers 1 are supported, can be chosen as a box-shaped, closed, straight trough 30, as shown in FIG. 6. This alternative design example of the support beam 7 proves particularly advantageous in view of the lubrication required for the bearings 31 and 32, which can be effected e.g. with an oil bath arrangement without danger of contamination for the roving 14, and in consideration of the noise generated.

Furthermore, the elements for jointly driving all flyers 1 of a row can be arranged in the trough 30; in FIG. 6 there is shown e.g., in which manner the hollow axis or shaft 10 of the flyer head 6 supports a toothed belt pulley 33 between the two bearings 31 and 32, which in a manner known as such meshes with a toothed tangential belt 34. The return leg or run of the belt 34 is designated by reference numeral 35. Of course, the solution shown here for the drive of the flyers 1 in a trough 30 represents just one example of many other possible solutions, such as e.g. gear drives or group-drive using a plurality of drive belts, etc.

Furthermore, FIG. 2 shows, in which manner in a double row preparatory spinning machine the beam 20 is arranged in the symmetry plane between two planes containing the spindle ãxes x, and can be moved up and down using means not shown, and can be equipped on both sides with a row of grippers 15 and bobbin tube support members 16. This arrangement permits serving two rows of spindles using only one beam 20, and thus is economically very advantageous.

Additional advantages can be achieved by using the above mentioned solution, if the single beam 20 is provided with a single revolving chain 21 with a lower longitudinal leg 22 and an upper longitudinal leg 23, which chain 21 is formed by individual segments not described in more detail, and the legs or runs 22 and 23 of which chain 21 are guided in the beam 20 by suitable longitudinal guides 36*a*. Also one single chain 21 for two rows of spindles is economically advantageous.

Furthermore, the connection of the grippers 15 and the bobbin tube support members 16 at each side of the beam 20 with the chain 21 is effected using bevelled arms 28 at both sides, in such manner that in the lowered state of the beam 20 (as shown in FIG. 2), in which the full bobbin packages 2 are just gripped by the grippers 15, the lower leg 22 of the chain 21 is located immediately above one of the two troughs 30, and that the bevelled arms 28 of the chain 21 enclose the trough 30 at both sides.

Using this arrangement of the chain 21, room is saved in the height of the machine, mainly if this arrangement is chosen in connection with the above mentioned solution of mounting the grippers 15 and the bobbin support members 16 on the chain 21 with a respective bearing 36, owing to which the grippers 15 and the bobbin tube support members are taken up at the chain 21.

In a preferred alternative embodiment of the invention, which is applied in a double row preparatory spinning machine with troughs 30 for the flyer bearings, the following relation is maintained between the dimensions of the machine:

$$a-D>b$$

where

D=diameter of the finished bobbin package a=distance between the two rows of spindles b=maximum width of the troughs in their pivoted-out state, as measured in a top view projection of the machine.

By maintaining this relation the vertical doffing of the bobbin 2 on the double row preparatory spinning machine becomes very simple, if the flyers 1 are pivoted according to the invention, as one of the two troughs 30 is pivoted into the free room or space between the two rows of spindles and thus does not obstruct the joint doffing of the full bobbins 2 from both rows.

In FIGS. 4 and 5 furthermore it is shown, with reference to the bobbin tube support members 16, which can be designed identical with the grippers 15, how they can be linked to the chain 21 using a bearing 36, in this arrangement e.g. using a bevelled arm 28: for this purpose the bobbin tube support member 16 is connected rigidly with a bearing block 37, which is freely supported on an axis or shaft 38 which in turn is rigidly connected with the arm 28. Two setting rings 39 and 40 take care of the axial guidance of the bearing block 37 on the axis 38. Owing to this arrangement the bobbin tube support members 16, or the grippers 15 (not shown here), at all times can hang in their vertical position under the influence of gravity and independently of the position of the arm 28 in the room, and particularly also while the chain 21 revolves (compare FIGS. 3*e*, 3*k*, and 3*l*).

According to a further preferred embodiment of the inventive apparatus the bearings 36 for the bobbin tube support members 16 are equipped with elastic shape hugging elements, e.g. with spring-loaded or spring balls 42, which snap into a groove 41 of the axis or shaft 38, which secure the bobbin tube support members 16 located in the lower chain leg or run 22 in their vertical position. This solution ensures, that the bobbin tubes 17 always are held securely in their vertical position during the donning operation (according to FIGS. 3*f* through 3*h*), and that thus there is eliminated the danger of individual bobbin tubes 17 being arranged at an inclination with respect to the room and thus, could not be donned correctly onto the spindle 29 (compare FIG. 3*g*).

As grippers 15, and as bobbin tube support members 16, respectively, e.g. the so-called Casablanca-pins, well known in practical spinning mill use, are well suited.

It should be noticed furthermore, that the pivoting of the flyers 1 of the preparatory spinning machine about an axis parallel to the longitudinal machine axis is not the only manner possible of perfecting such a pivoting motion within the scope of the present invention. Thus, also solutions can be considered, in which the pivoting axis of each flyer 1 is arranged e.g. at a bias or transversely to the longitudinal axis of the preparatory spinning machine.

While there are shown and described present preferred embodiments of the invention, it is to be distinctly understood that the invention is not limited thereto, but may be otherwise variously embodied and practiced within the scope of the following claims. Accordingly,

We claim:

1. A method of automatically doffing full bobbin packages from and donning empty bobbin tubes onto spindles of a preparatory spinning machine equipped with at least one row of spindles and flyers, each flyer being rotatably supported at a flyer head above a related spindle and comprising two flyer arms and a flyer yoke, comprising the steps of:

shutting down the spinning preparatory machine with the flyers located in a same predetermined position;

pivoting all of the flyer heads in a plane extending substantially at right angles to a plane containing both flyer arms of each flyer when each said flyer is located in said same predetermined position, each flyer being pivoted into a position where the flyer yoke thereof does not obstruct vertical doffing of the full bobbin package from its related spindle;

conjointly vertically doffing the full bobbin packages from all spindles arranged in a row, while the roving is severed between the flyer and the bobbin package and there is formed a free fiber beard at the flyer;

conjointly removing the bobbin packages from the doffing position located vertically above the spindles, and transferring empty bobbin tubes into the same position;

conjointly vertically donning the empty bobbin tubes onto all of the spindles arraged in a row, with the severed free fiber beard at the related flyer being clamped between a foot of the bobbin tube and its related spindle;

pivoting back all of the flyer heads into their working positions above the spindles; and starting-up the preparatory spinning machine.

2. The method as defined in claim 1, including the step of:

pivoting all of the flyer heads in a plane disposed essentially at right angles with respect to the plane containing the row of spindles.

3. The method as defined in claim 1, further including the steps of:

pivoting the flyer heads approximately along a substantially circular arc.

4. The method as defined in claim 1, wherein:

removal of the bobbin packages and transfer of the emtpy bobbin tubes is effectuated by shifting them along a plane containing the spindles.

5. A preparatory spinning machine for automatically doffing full bobbin packages from and donning empty bobbin tubes into spindles of such preparatory spinning machine which is equipped with at least one row of spindles and with flyers, each of the flyers being rotatably supported at a flyer head above a related spindle, and each flyer comprising flyer arms and a flyer yoke, comprising:

a common support beam extending in a longitudinal direction of the preparatory spinning machine;

said flyer heads of the flyers of the spindles which are arranged in a row being supported by said common support beam;

means for imparting to said common support beam for the doffing of bobbin packages and the donning of empty tubes a translatory movement in such a manner that each flyer is substantially pivoted about an axis which substantially symmetrically intersects both flyer arms at lower regions thereof;

a doffing and donning element provided above said spindles;

means for supporting said doffing and donning element for substantially vertical up-and-down movements;

said doffing and donning element comprising for each spindle a gripper for the full bobbin and a bobbin tube support member for the empty bobbin tube; and control means for bringing each of the flyers to standstill in a predetermined position contemplated for performing pivotal motions thereof and for effectuating the doffing operation.

6. The preparatory spinning machine as defined in claim 5, wherein:

said doffing and donning element comprises a beam extending over the entire row of spindles.

7. The preparatory spinning machine as defined in claim 6, wherein:

said beam contains a chain revolving in a substantially vertical plane; and said grippers and bobbin tube support members being mounted along said chain.

8. The preparatory spinning machine as defined in claim 7, wherein:

said chain contains two substantially longitudinally extending chain runs;

said grippers being mounted at a substantially equal mutual spacing from one another, essentially corresponding to a predetermined spindle gauge of said spindles, at one longitudinally extending run of said chain;

said bobbin tube support members being mounted at a substantially equal mutual distance from one another, essentially corresponding to the spindle gauge, at the other longitudinally extending run of said chain; and transfer of each bobbin package from and each bobbin tube to a related one of the spindles is effected by conjointly eliminating the bobbin packages from a doffing position located vertically above the spindles and transferring the empty bobbin tubes into the same position by revolving the chain over approximately one-half of its length.

9. The preparatory spinning machine as defined in claim 8, further including:

bearing means for mounting said grippers and said bobbin tube support members upon said chain in such a manner that such grippers and bobbin tube support members hang down from the chain under the influence of gravity.

10. The preparatory spinning machine as defined in claim 9, wherein:

said bearing means for the bobbin tube support members are equipped with elastic elements which secure the bobbin tube support members located at one of the longitudinally extending chain runs in a substantially vertical hanging position.

11. The preparatory spinning machine as defined in claim 10, wherein:

said elastic elements comprise spring-loaded balls.

12. The preparatory spinning machine as defined in claim 5, wherein:

said common support beam extends in longitudinal direction of the machine and is structured as a substantially box-shaped, enclosed, straight trough containing bearing means for all flyers arranged in a row.

13. The preparatory spinning machine as defined in claim 12, wherein:

said trough further includes means for conjointly driving all of the flyers in a row.

14. The preparatory spinning machine as defined in claim 13, wherein:

said machine contains two substantially parallel rows of spindles.

15. The preparatory spinning machine as defined in claim 14, wherein:

said doffing and donning element comprises a beam extending over the entire row of spindles;

said beam comprising a single doffing and donning beam provided for both rows of spindles; and said single doffing and donning beam can be moved in a plane of symmetry between the two rows of spindles up and down vertically and at both sides thereof supports one respective row of grippers and bobbin tube support members.

16. The preparatory spinning machine as defined in claim 15, wherein:

said single doffing and donning beam is equipped with one single revolving chain; and said grippers and said bobbin tube support members being connected at each side of the single doffing and donning beam with said revolving chain by arm members beveled at both sides in a manner such that if the doffing and donning beam is in a lowermost state thereof a lower run of said chain is located immediately above one of said troughs and said beveled arms enclose the trough at both sides thereof.

17. The preparatory spinning machine as defined in claim 13, wherein:

said machine comprises two substantially parallel rows of spindles; and the dimensions of the machine fulfill the following relationships:

$$a-D>b$$

wherein:

D = diameter of the fully built-up bobbin package;

a = distance between the two rows of spindles; and b = maximum width of the trough in a pivoted-out position thereof and measured as seen in plan view.

* * * * *